United States Patent [19]

Schaffner et al.

[11] 3,974,774

[45] Aug. 17, 1976

[54] PROJECTILE FOR A WEAPON SYSTEM

[75] Inventors: Joseph G. Schaffner, Timonium; Joseph A. Werner, Joppa; Jacob Klein, Baltimore, all of Md.

[73] Assignee: The United States of America as represented by the Secretary of the Army, Washington, D.C.

[22] Filed: Nov. 2, 1971

[21] Appl. No.: 194,837

[52] U.S. Cl. ..... 102/90; 102/65; 89/1.816

[51] Int. Cl.[2] ..... F42B 13/46

[58] Field of Search ..... 102/65, 67, 87, 6, 66, 102/90; 149/87

[56] References Cited

UNITED STATES PATENTS

| | | | |
|---|---|---|---|
| 2,402,811 | 6/1946 | Galen | 102/73 R |
| 3,433,437 | 3/1969 | Bates | 102/66 |
| 3,616,755 | 11/1971 | Davis | 102/79 |
| 3,634,156 | 1/1972 | Batson | 149/87 |

*Primary Examiner*—Verlin R. Pendegrass
*Attorney, Agent, or Firm*—Nathan Edelberg; Robert W. Church

[57] ABSTRACT

A projectile for use in a multishot portable weapon system containing a viscoelastic solution of high molecular weight polyisobutylene in triethylaluminum to be delivered to a target site to inflict casualties and/or produce a conflagration.

3 Claims, 34 Drawing Figures

INVENTORS
Joseph G. Schaffner
Joseph A. Werner
Jacob Klein

BY Harry M. Saragovitz
Edward J. Kelly
Herbert Berl
Bernard J. Ohlendorf
ATTORNEYS INVENTORS
Joseph G. Schaffner
Joseph A. Werner
Jacob Klein
Harry M. Saragovitz
Edward J. Kelly
Herbert Berl
Bernard J. Ohlendorf
BY
ATTORNEYS

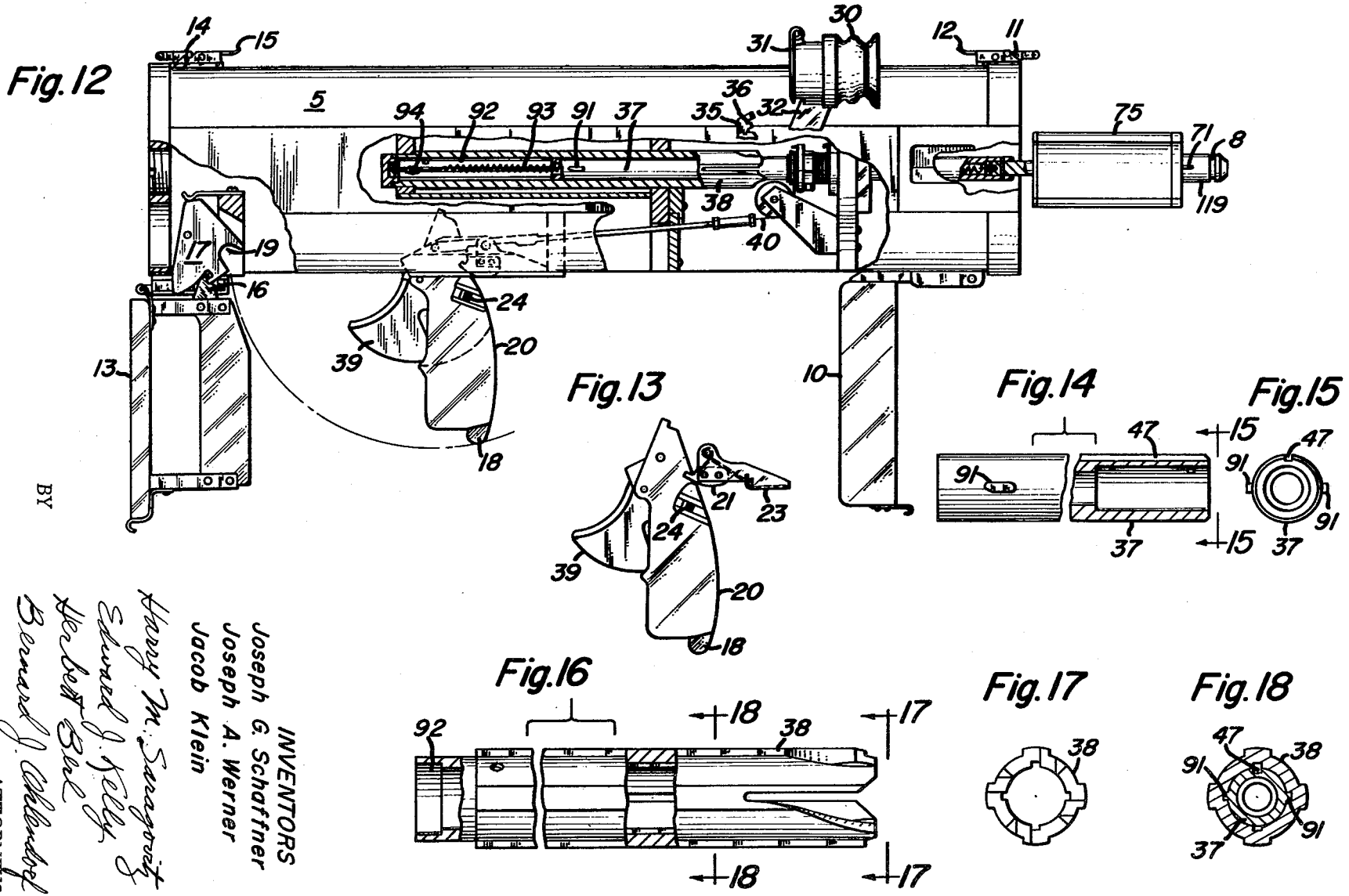
INVENTORS
Joseph G. Schaffner
Joseph A. Werner
Jacob Klein
Harry M. Saragovitz
Edward J. Kelly
Herbert Berl
Bernard J. Ohlendorf
ATTORNEYS
BY

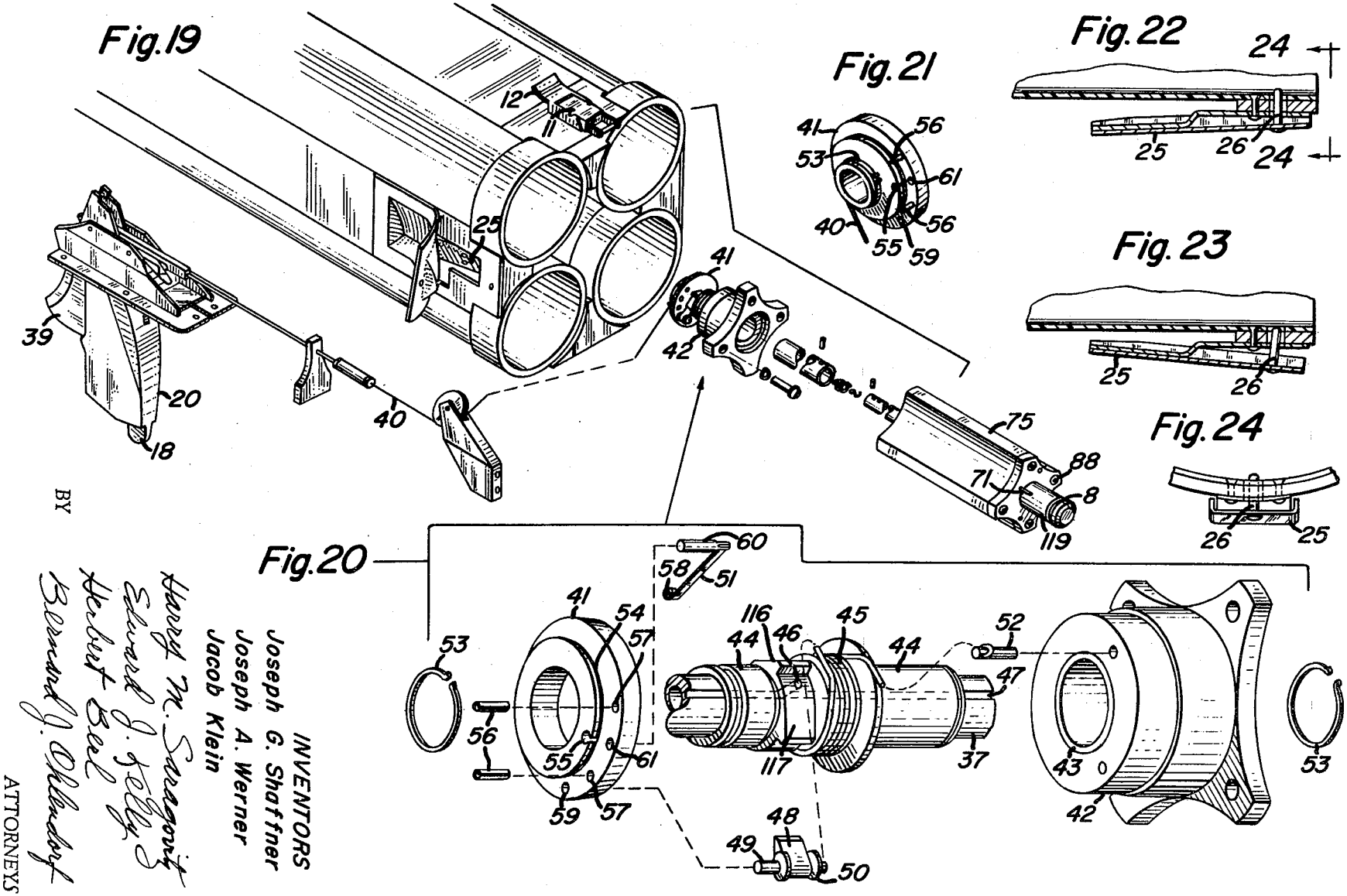
INVENTORS
Joseph G. Shaffner
Joseph A. Werner
Jacob Klein
BY Harry M. Saragovitz
Edward J. Kelly
Herbert Berl
Bernard J. Ohlendorf
ATTORNEYS INVENTORS
Joseph G. Schaffner
Joseph A. Werner
Jacob Klein
Harry M. Saragovitz
Edward J. Kelly
Herbert Berl
BY Bernard J. Ohlendorf
ATTORNEYS INVENTORS
Joseph G. Schaffner
Joseph A. Werner
Jacob Klein BY Harry M. Saragovitz
Edward J. Kelly
Herbert Berl
Bernard J. Ohlendorf
ATTORNEYS

PROJECTILE FOR A WEAPON SYSTEM

DEDICATORY CLAUSE

The invention described herein may be manufactured, used, and licensed by or for the Government for governmental purposes without the payment to us of any royalty thereon.

Our invention relates to a projectile for use in a weapon system such as a multishot portable weapon system for delivery of an incendiary material payload to a target site to defeat or neutralize hard and soft targets and/or initiate conflagrations.

While many means are known in the prior art for launching and disseminating incendiary materials, such as disclosed in U.S. Pat. No. 3,433,437 and pending U.S. Pat. Applications Ser. No., each filed on, many problems existed with the prior art devices; such as being too sophisticated, requiring electrical activation of a propellant section to deliver the incendiary material to a target site rather than a simple mechanical activation, misfiring and similar malfunctions in spite of claims to the contrary, the necessity to use extreme caution in oxygen free atmospheres when filling the projectile with incendiary payload due to the composition of the payload, the necessity to use complicated means to arm the device such as spin activated air arming fuzes, the necessity to utilize complicated means to stabilize the projectile in flight, utilization for short range delivery only, inefficient operation, poor concentration of the incendiary material on the target site, necessity for fuel recharging, production of a readily identifiable signature due to the flame rod, presentation of a vulnerable weapon silhouette. Our invention was conceived and reduced to practice to solve the aforementioned problems and to satisfy the long felt need for a projectile for a multishot and portable apparatus and system to effectively, efficiently, and accurately deliver an incendiary material payload to a target site.

The principal object of our invention is to provide a simple, efficient, accurate, effective, and long range projectile for use with a portable multishot apparatus and system to deliver an incendairy material payload to a target site.

Another object of our invention is to provide a projectile to deliver an incendiary material to a target site for use with an apparatus and system which is actuated by simple mechanical means without a danger of misfiring or similar malfunction and which eliminates complicated arming means such as spin activated fuzes through the utilization of a fuze with graze element which in turn activates a central burster means to detonate the projectile on glance striking or direct impact.

Still another object of our invention is to make use of a projectile containing a pyrophoric incendiary material to insure spontaneous and complete ignition of the incendiary charge when the projectile is detonated; a separate ignition system not being required.

A further object of our invention is to provide a projectile for delivering incendiary material to a target site which employs simple retractable fins to stabilize the projectile in flight.

A still further object of our invention is to provide a projectile for use in an apparatus and system for delivering incendiary material to a target site which does not necessitate fuel recharging, does not produce a readily identifiable signature due to the flame rod, and does not present a vulnerable weapon silhouette.

Other objects of our invention will be obvious or will appear from the specification hereinafter set forth.

FIG. 12 is a cutaway view showing the components of the launching apparatus without the rocket clip.

FIG. 13 is a view of the handle and trigger mechanism of the apparatus.

FIG. 14 is a view of the extension shaft assembly of the apparatus.

FIG. 15 is a view through 15—15 of FIG. 14.

FIG. 16 is a view of the safety guide assembly of the apparatus.

FIG. 17 is a view through 17—17 of FIG. 16.

FIG. 18 is a view through 18—18 of FIG. 16.

FIG. 19 is a view of the launcher tube assembly and firing train.

FIG. 20 is an exploded view of the ratchet and drum assemblies.

FIG. 21 is a view of the cable drum assembly.

FIG. 22 is a view of the detent assembly locking the rocket clip in position.

FIG. 23 is a view of the detent assembly shown in FIG. 22 but in the open or depressed position to permit sliding the rocket within the launcher tube.

FIG. 24 is a view through 24—24 of FIG. 22.

Our invention as shown in FIGS. 1 to 34 will now be described in detail as follows.

Figure 1:
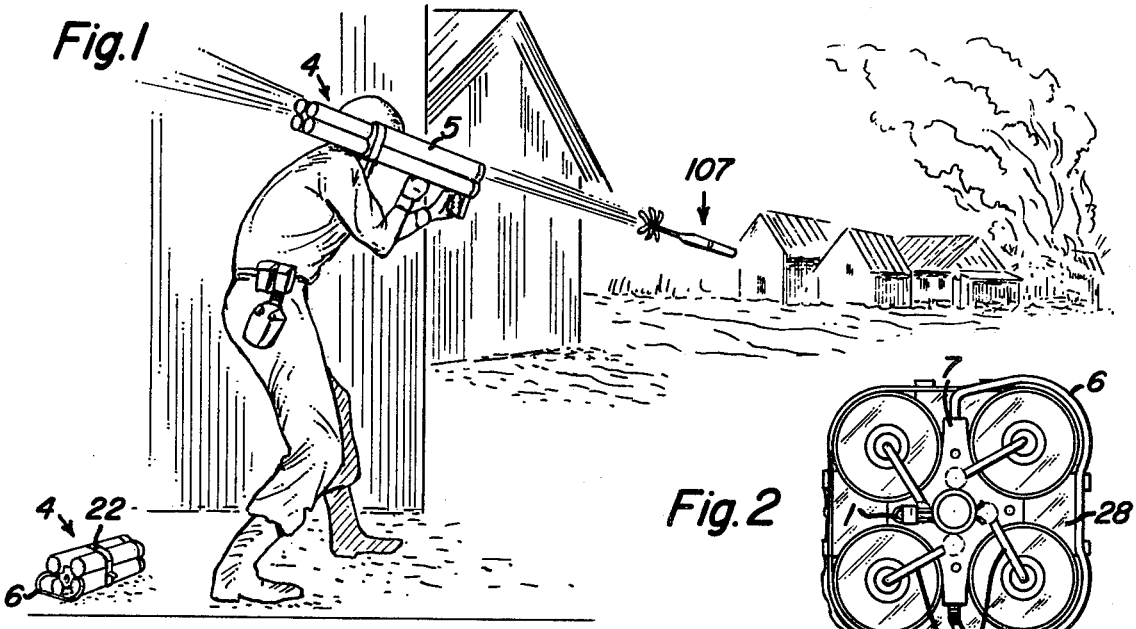
FIG. 1 is a view showing the utility of our projectile with the apparatus and system in the firing mode.
Figure 2:
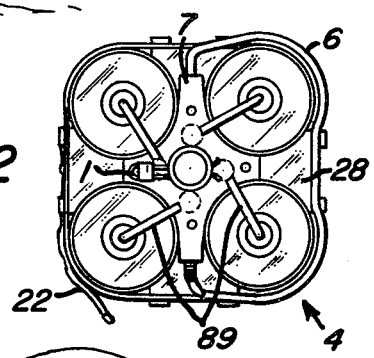
FIG. 2 is a view of the aft end of the rocket clip for the apparatus which utilizes our projectile and showing rocket motor igniters leading to the primer manifold.
Figure 3:
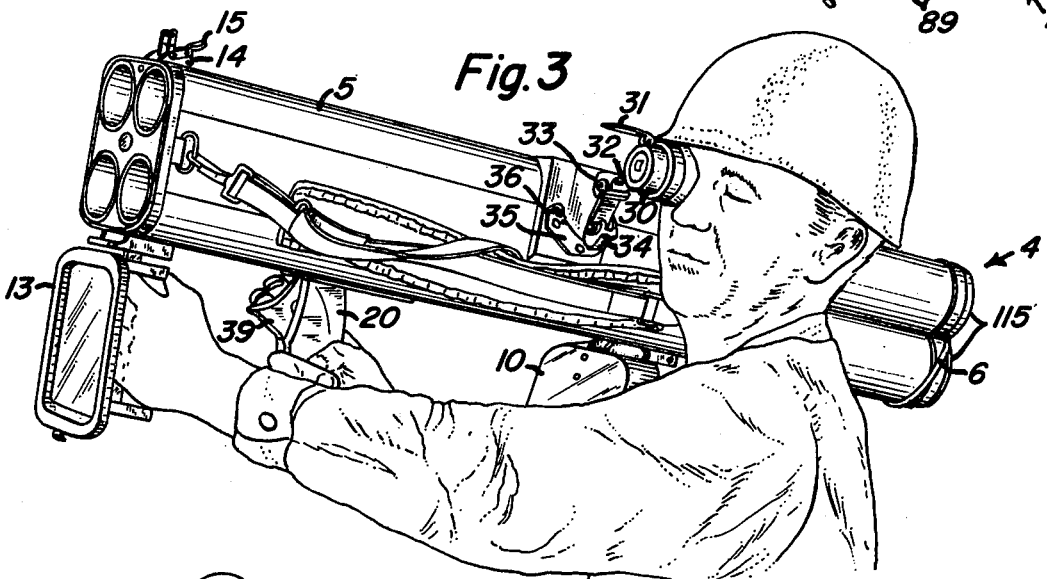
FIG. 3 is a view showing the utility of the apparatus and system which utilizes our projectile in the mode preparatory to firing as in FIG. 1.
Figure 4:
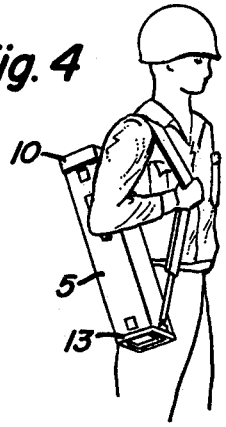
FIG. 4 is a view showing the transport to the firing site of the apparatus and system for launching our projectile to a target site.
Figures 5, 6, 7, 8, 9, 10, 11:
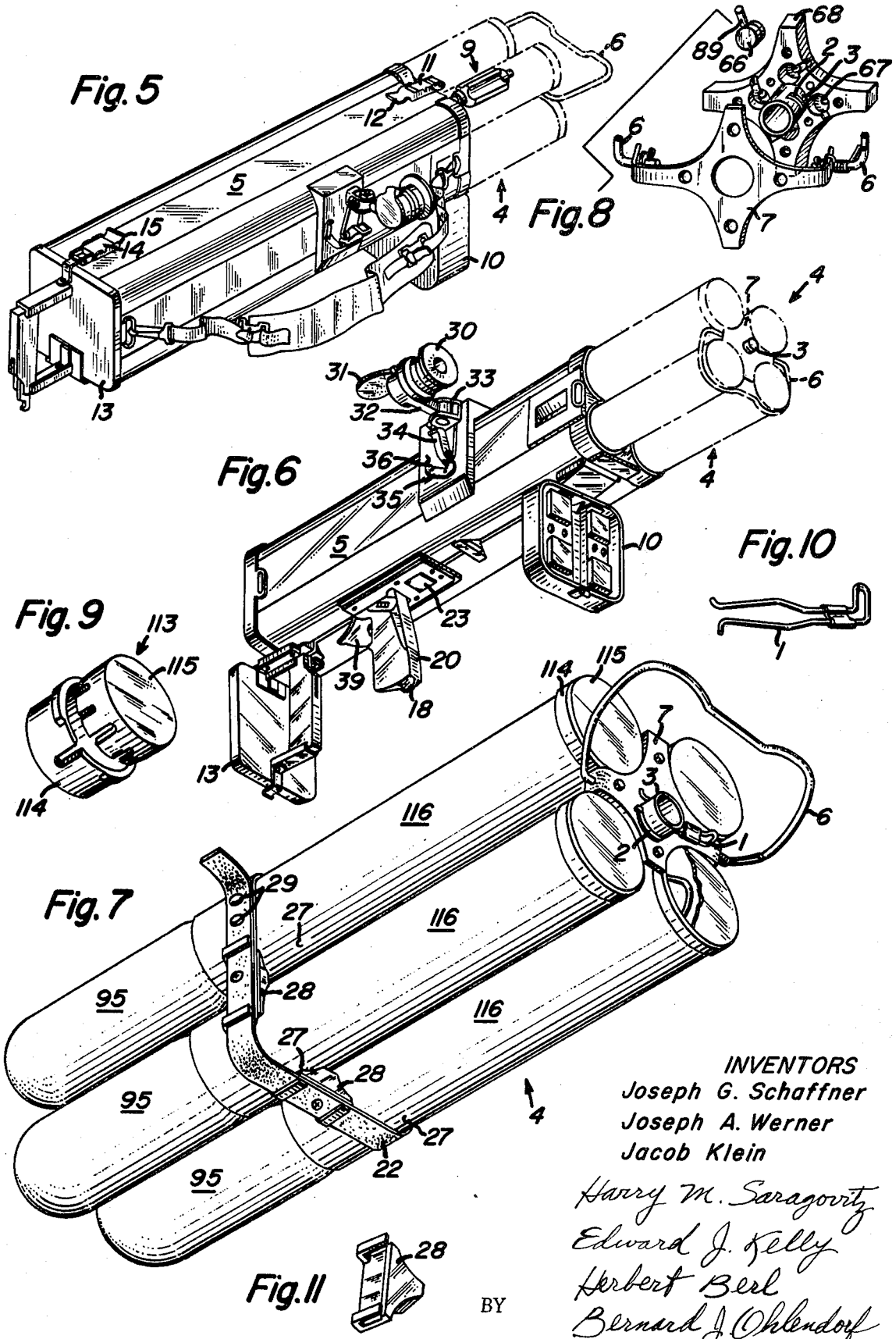
FIG. 5 is a view of the apparatus for launching our projectile with the rear cover open and the rocket clip shown in phantom.
FIG. 6 is a view of the apparatus, as in FIG. 5, with the front cover open, the trigger mechanism in the firing mode, and the sight in the open position for aiming.
FIG. 7 is a view of the rocket clip to contain our projectile for launching.
FIG. 8 is a detailed view of the aft end of FIG. 7.
FIG. 9 is a detailed view of the rocket retainer assembly.
FIG. 10 is a view of the retainer clip.
FIG. 11 is a view of the clip support spacer.
Figure 25:
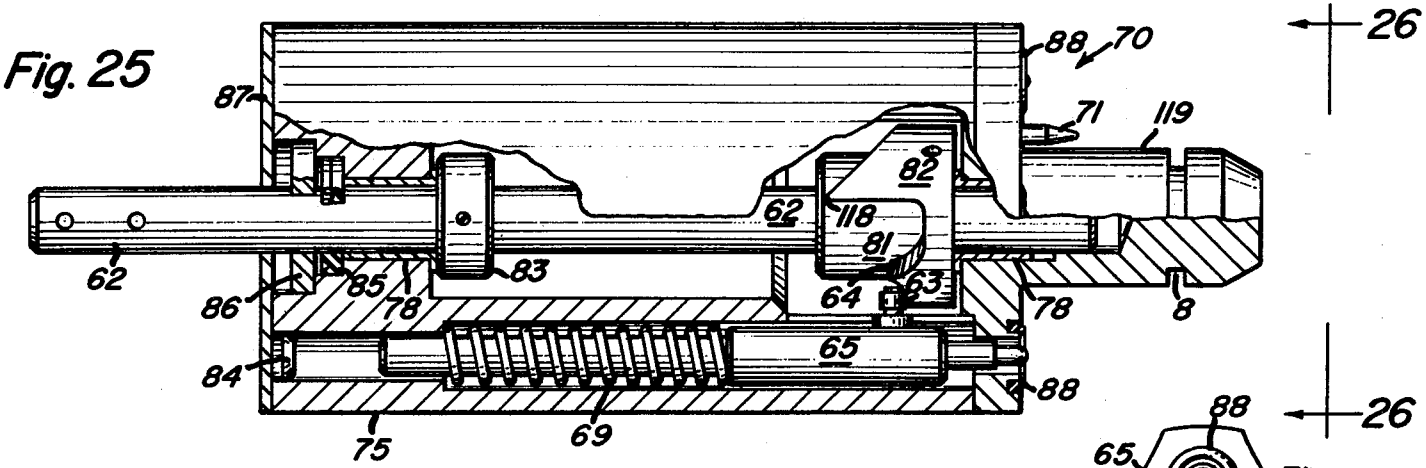
FIG. 25 is a view of the firing pin mechanism assembly of the apparatus.
Figure 26:
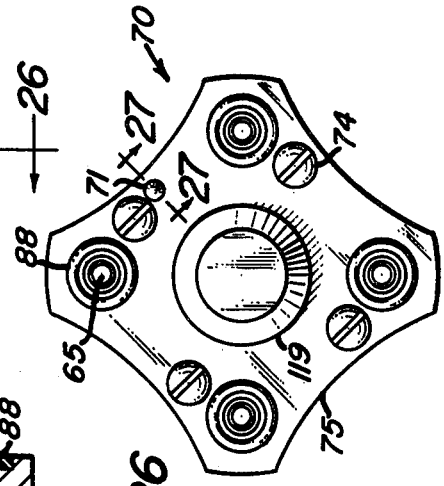
FIG. 26 is a view of the firing pin mechanism cover assembly of the apparatus through 26—26 of FIG. 25.
Figure 27:
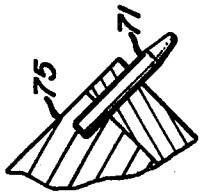
FIG. 27 is a view through 27—27 of FIG. 26.
Figure 28:
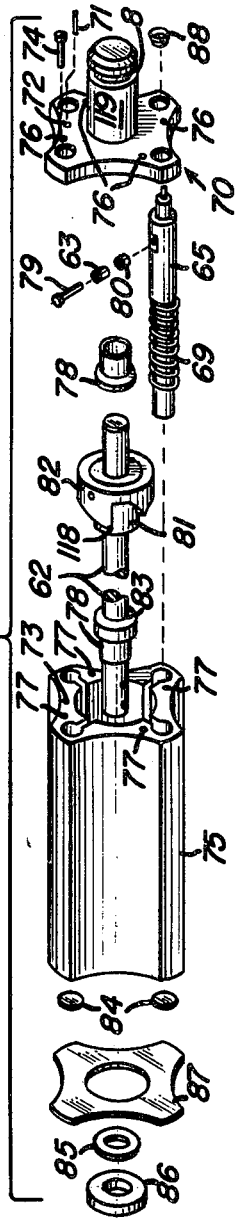
FIG. 28 is an exploded view of the firing pin mechanism assembly shown in FIG. 25.
Figure 29:
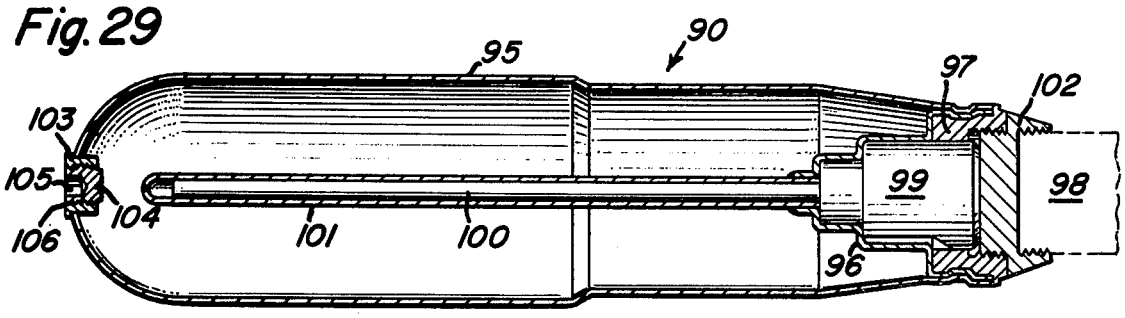
FIG. 29 is a view of a warhead assembly embodiment of our projectile for the rocket clip for the apparatus; this embodiment having case, fuze well, and fuze well boss welded together at the aft end and a burster tube welded to the fuze well.
Figure 30:
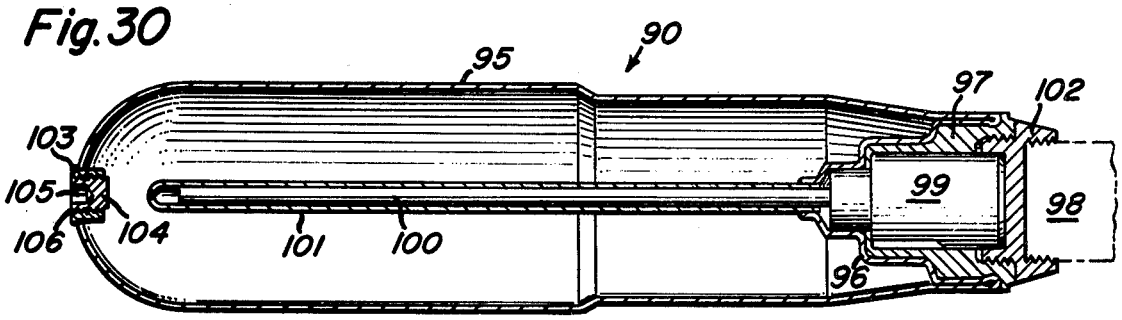
FIG. 30 is a view of a warhead assembly embodiment as in FIG. 29; this embodiment having an integral case and fuze well formed by deep reverse draw at the aft end.
Figure 31:
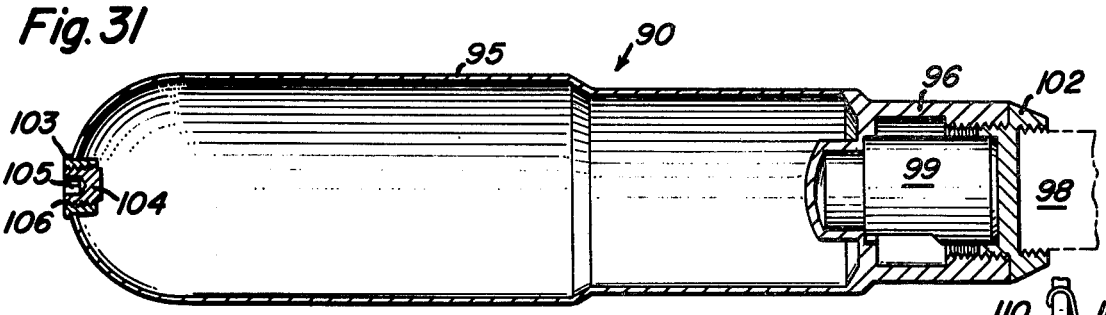
FIG. 31 is a view of a warhead assembly embodiment as in FIG. 29; this embodiment having a one piece extruded case and fuze well and a threaded boss at the aft end.
Figure 33:
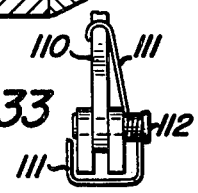
FIG. 33 is a view of the fin assembly shown in FIG. 32.
Figure 32:
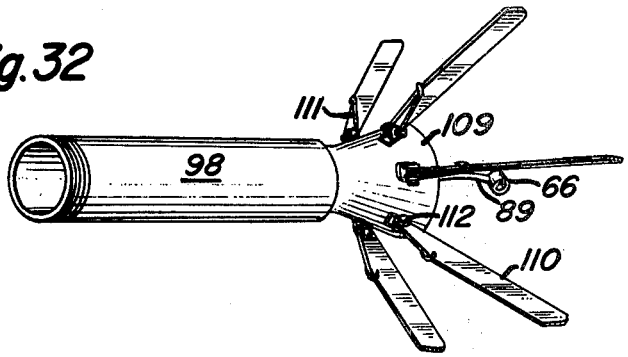
FIG. 32 is a view of the rocket motor housing and fin assembly for our projectile.
Figure 34:
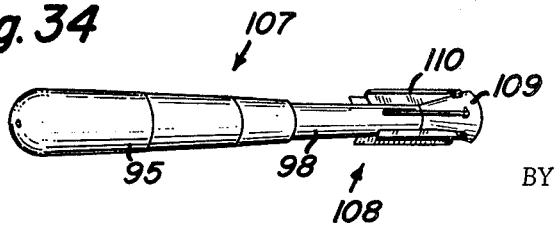
FIG. 34 is a pictorial view of our projectile to be used with the apparatus.

Clip retainer 1, as shown in FIG. 10, is held in position by friction fit in slots 2 of manifold tube 3, as shown in FIGS. 7 and 8, and rocket clip 4, as shown in FIG. 7, is picked up by bail 6 and inserted within launcher means 5 while depressing spring latch 25, as shown in FIG. 23, to prevent detent 26 from engaging recess 27, as shown in FIG. 7; rocket clip 4 being pushed within launcher means 5 until shaft 119, as shown in FIG. 12, protrudes through manifold tube 3 and recess 8 mates with slots 2. Clip retainer 1 is automatically engaged by friction fit within slots 2 and recess 8 to maintain rocket clip 4 in a fixed position around firing pin mechanism assembly 75 shown at 9 in FIG. 5, rear cover 10 is closed, and the apparatus is carried to a firing site as shown in FIG. 4. Prior to inserting rocket clip 4 within launcher means 5, strap means 22 and spacers 28 are removed by unfastening conventional snap fasteners 29, spacers 28, and strap 22 being shown in FIGS. 7 and 11. At the firing site, rear cover 10 is opened by releasing spring loaded latch 11 by lifting end 12, and front cover 13 is released in the same manner as rear cover 10 by releasing spring loaded latch 14 by lifting end 15 and cover 13 is rotated and retained in the open position, by latch 16 engaging toggle means 17 as shown in FIG. 12. Engagement of latch 16 with toggle means 7 simultaneously releases trigger handle latch 18 from toggle means recess 19, and the trigger handle assembly 20 is manually extended to the firing mode until it engages spring loaded trigger handle latch 21 to lock the trigger handle assembly in the open position, as shown in FIG. 12. To close cover 13 and store the trigger handle assembly 20 in a recess in the under side of the launcher means 5. The above described procedure for opening is followed in reverse order when storing launcher means 5; latch 21 being released by depressing button 23 as shown in FIG. 6. A conventional safety means 24 is provided in the trigger handle assembly, as shown in FIGS. 12 and 13, to prevent inadvertent firing of the rockets from clip 4 prematurely when the launcher is in the firing mode, as shown in FIGS. 3 and 6; the forward position being the safe position and marked "5" and the rear position being the firing position and marked "F". Reflecting sight assembly 30 is positioned in the firing mode by opening lens cover 31 by hinge means, rotating arm 32 to the vertical position whitin friction hinge 33, and locking spring loaded arm 34 in a notch means at the end of elevation adjusting plate 35 opposite to the storing position notch 36, as shown in FIG. 6. Sight 30 provides the optical line of sight by which launcher means 5 is aimed in azimuht and elevation and can be provided with any suitable reticle pattern, not shown in the drawing, within the skill of the art to suit a given application. Lastly, at the firing site, rocket clip 4 is extended from the launcher means 5 by bail 6 until detent 26, FIGS. 22 and 24, which is located in each rocket tube at a predetermined location to permit clip 4 to be inserted in any orientation, snaps into recess 27, FIG. 7, to permit positioning of the extension shaft 37 out of the safety guide tube 38 which removes the restrictions on trigger 39 stroke travel and firing mechanism assembly 9, as shown in FIGS. 5, 6, and 12. Details of the extension shaft assembly 37 and guide tube assembly 38 are shown in FIGS. 14 to 18 and consist of shaft assembly 37, keys 91, safety guide 38 having the internal spline configuration as shown in FIG. 17 to accept the shaft assembly 37 key structure of FIG. 15, as shown in FIG. 18, and recess 92 to house spring and swivel structure 93 and 94 respectively, sivel 94 being fixedly mounted at the end of safety guide assembly 38 and extension shaft assembly 37 as shown in FIGS. 12 and 19; spring 93 and swivel 94 being utilized to permit return of the extension shaft within launcher means 5 when storing the launcher and the swivel permitting the rotation of extension shaft assembly 37 without winding up the spring. Launcher means 5 is then aimed, as shown in FIG. 3, safety means 24 moved to the "F" position, and a rocket fired at a target site, as shown in FIG. 1, by squeezing trigger 39. Each squeeze of trigger 39 applies tension to cable 40 connected to cable drum assembly 41, as shown in FIGS. 19 and 21, which causes the ratchet assembly shown in FIG. 20 to rotate 90°; the ratchet assembly consisting of mounting plate 42, bearing 43, ratchet shaft 44 inserted within bearing 43, torsion cable return spring 45 is located around shaft 44, drive pin 46 is press fit into shaft 44 and protrudes into the bore of shaft 44 to connect with groove 47 of extension shaft 37. Drum assembly 41 consists of pawl 48, pawl pin 49, washers 50, and pin and spring assembly 51. Pawl pin 49 and spin and spring assembly 51 are press fit into cable drum 41 by inserting pin 49 into hole 59 and pin 60 into hole 61, as shown in FIG. 20, and one end of torsion spring 45 is fastened to ratchet pawl pin 49 and the opposite end of spring 45 is fastened to support pin 52 which is press fit into mounting plate 42. Cable drum 41 and mounting plate 42 are secured onto ratchet shaft 44 by snap rings 53. Cable 40 is wrapped in drum groove 54 and held in position by locating the ball end of cable 40 in slot 55 and press fitting pins 56 in holes 57 of drum 41. Each squeeze of trigger 39 causes drum assembly 41 to rotate and pawl 40 fixedly mounted thereon to rotate with the drum assembly while at the same time pawl 48 is being put under spring tension through attachment to torsion cable return spring 45. Simultaneously with rotation of pawl 48, the pawl held under compression with spring assembly 51 against ratchet 117, engages one of the arms 116 of ratchet 117, each arm being spaced 90° apart in our apparatus, but each arm can be spaced any suitable distance to suit a given application within the skill of the art, and rotates ratchet shaft 44 and extension shaft assembly 37 90° by virtue of the connection of ratchet 117 therewith through drive pin 46. When trigger 39 reaches full travel and is released, pawl 48 is returned to the original position by tension from spring 45 and the action is cyclically repeated with each squeeze of trigger 39. Each rotation of the ratchet assembly causes cam shaft 62 to rotate through 90° and cause cam bearing 63 to move along cam surface 64, as shown in FIG. 25 for the firing pin mechanism assembly, to cock firing pin 65 as bearing 63 rides up to cam peak 118 and to release firing pin 65 under tension of compression spring 69 after peak 118, FIG. 25, has passed bearing 63 to detonate primer 66 mounted in cavities 67 of manifold 68, as shown in FIG. 8; cover means 7 being fixedly mounted on structure 68. Each time trigger 39 is squeezed, a different firing pin is released to strike a primer until all rockets have been expelled from launcher 5. While the drawing shows the utilization of four launching tubes, it is within the skill of the art to utilize our teaching to design a launching means to have any number of tubes to suit a given application. The firing pin mechanism assembly, as shown in FIGS. 25, 26, 27, and 28, consists of a cover 70, alignment pin 71 to align hole 72 with hole 73, machine screws 74 to mount cover 70 on housing 75 with mating holes 76 and 77, bearings 78, firing pin 65, compression spring 69, cam follower pin 79 press fit into firing pin 65 which supports guide sleeve 80, and cam bearing 63, cam shaft 62, cam sleeve 81, cam 82, collar 83, rubber seats 88, housing 75, gas checks 84 press fit into recesses in housing 75, cam shaft packing 85, retainer 86 for packing 85, and rubber spacer 87 affixed to the end of housing 75 by adhesive as shown in FIG. 25. Upon detonation of primer 66 by firing pin 65, flame from the detonation ignites rocket motor igniters 89, as shown in FIGS. 2 and 32, which in turn ignites a conventional rocket motor, not described herein and not being a part of this invention but the rocket motor housing is shown as structure 98 in FIGS. 29 to 34, which propels the projectile shown at 90 of our invention, as shown in FIGS. 29 to 31 and 34, to the target site. While any suitable case means can be designed within the skill of the art to suit any given application for projectile 90, the embodiments shown in FIGS. 29 to 31 are preferred for our projectile. The FIG. 29 embodiment utilizes a deep drawn case 95 having case 95, fuze well 96, and fuze well boss 97 welded together to form an integral unit for mounting a conventional set back arming fuze 99 therein, conventional burster assembly 100 to be detonated by fuze 99 upon impact of projectile 90 at the target sit and burster assembly 100 to disseminate payload 101 upon detonation of assembly 100, and conventional threaded adapter 102 to mount and seal conventional rocket motor assembly 98 therein. A conventional filler plug boss 103 is fixedly mounted within case 95 by any conventional means, such as welding, and conventional filler plug 104 is mounted by any convenient means such as threadably in boss 103, after loading payload 101 within case 95, by inserting a tool means within tool recess 105; the plug and boss structure being the same for each embodiment shown in FIGS. 29 to 31. If desired, a sealing material may be applied within the skill of the art to suit a given application to threads 106 prior to inserting plug 104 in boss 103. The embodiment shown in FIG. 30 is identical to the FIG. 29 embodiment except case 95 and fuze well 96 are an integral reverse deep draw structure and fuze well boss 97 is bonded in position by any conventional adhesive material to suit a given application and mechanically held in position, such as by press fit. The embodiment shown in FIG. 31 is identical to the FIG. 29 and FIG. 30 embodiments except that case 95 and fuze well 96 are a one piece impact extruded structure having threaded boss 97 therein and burster assembly 100 is a conventional explosive burster charge located within tube 101. Each rocket as stored in rocket clip 4 prior to launch is shown at 107 in FIG. 34 and consists of case 95 constituting the warhead containing the payload, adapter 102, and the rocket motor assembly shown at 108; assembly 108 consisting of rocket motor housing 98, igniter 89, and fin assembly 109, as shown in FIG. 32 and FIG. 34; fin assembly 109 consisting of fins 110, clip spring 111 to open fins 110 in flight, and rivet pivot shaft 112 for mounting spring 111 and fins 110; as shown in FIG. 33. Fuze 99 is armed when the rocket shown at 107 accelerates in flight, and the fuze can be set within the skill of the art to arm at any given velocity to suit any particular application. Any conventional rocket motor having noncanted fins, no nozzles, and utilized without spin can be employed in our projectile. Rocket retainer assembly, shown at 113 in FIG. 9, consists of tube cap 114 and rocket retainer 115; the assembly 113 being used to hold each rocket shown at 107 in FIG. 34 within tube 116, as shown in FIG. 7, for example, provides protection for igniter 89 prior to launching of the rocket, and assembly 113 is blown off by the rocket motor's exhaust pressure when the rocket is launched. While any suitable payload 101 can be used within the skill of the art with the rocket in our invention, such as incendiary, chemical, or explosive composition, our preferred payload is an incendiary composition. A problem existed with prior art incendiary compositions, such as gelled or thickened gasoline, which precluded their use in our apparatus, because the prior art compositions did not ignite and burn completely at the target site due to the inefficiency of the ignition system and the lack of long term stability using available gasolines. A research program was conducted in an effort to utilize a solution of polyisobutylene in triethylaluminum, hereinafter referenced as PIB and TEA respectively, as the payload in our apparatus, but all efforts produced an unsatisfactory payload until it was unexpectedly found that a viscoelasticity was introduced into the TEA which controlled the breakup of PIB-TEA to permit efficient dissemination when a high molecular weight PIB having an empirical Standinger molecular weight of approximately 200,000 and a viscosity-average molecular weight of about 5,000,000 was dissolved in the TEA. Commercially available PIB, such as Vistanex L-200 and Opanal B-200, dissolved in TEA in the amount of approximately 5 to 6 weight % produced a satisfactory payload for our apparatus which disseminated under mild explosive conditions. The L-200 and B-200 notation references the empirical Standinger molecular weight of about 200,000. The aforementioned term viscoelasticity is a simplistic combination derived from terms viscous and elastic which phenomenologically expresses the general rheological behavior of polymer-thickened liquids as well as many other fluids. Rheological properties for our PIB-TEA are set forth in the table below; the relaxation time being considered as the best single property to express the degree of viscoelasticity.

Reological Properties Measured at 25°C For 6 wt. % PIB in TEA

| Property | Value |
|---|---|
| Applied Shear Stress ($\tau$) | 4.83 dyne/sq. cm. |
| Shear Rate ($\gamma$) | 0.00373 second $^{-1}$ |
| Calculated Recoverable Shear ($r_R$) | 0.784 shear units |
| Apparent Viscosity ($\eta_a$) | 1300 poise |
| Shear Modulus (G) | 6.17 dyne/sq. cm. |
| Normal Stress ($P_n$.) | 3.79 dyne/sq. cm. |
| Relaxation Time ($T_4$) | 210 seconds |

The above rheological properties are mathematically defined as follows: Shear Stress $= \tau = T/2\pi r_i^2 l_o$ wherein $T =$ applied torque in dyne-centimeters, $r_i =$ the radius of the inner cylinder (rotor) in centimeters of two concentric biconical cylinders of a modified Mooney - Ewart rotational viscometer having an air bearing incorporated to counteract the weight of the rotor to produce nearly frictionless motion and designed to enclose a sample substantially completely and operated in a shear rate range of $10^{-6}$ to $10^{1}$ $sec^{-1}$ under torque applied by weights suspended from the shaft of the rotor, and $l_o$ = equivalent length of the aforementioned inner cylinder; Shear rate $= \dot{\gamma} = 2\omega/(1 - c^2)$ wherein $\omega$ = angular velocity of the aforementioned inner cylinder in radians/second and $c$ = ratio of radii of inner to outer cylinders of the aforementioned viscometer. Recoverable Shear $= r_R = 2\phi_R (1 - c^2)$ wherein $\phi_R$ is the angular displacement of the aforementioned inner cylinder under elastic recoil in radians and $c$ is as defined above; Apparent Viscosity $= \eta_a = (\tau/\dot{\gamma})$ wherein $\tau$ is the Shear Stress defined above and $\dot{\gamma}$ is the Shear Rate defined above; Shear Modulus $= G = \tau/r_R$ wherein $\tau$ is the Shear Stress defined above and $r_R$ is the Recoverable Shear defined above; Normal Stress $= P_n = \tau \cdot rR$ wherein $\tau$ is the Shear Stress defined above and $r_R$ is the Recoverable Shear defined above; Relaxation Time $= T_R = \eta/G = r_R/\gamma$ wherein $\eta$ = Viscosity, G is the Shear Modulus defined above, $r_R$ is the Recoverable Shear defined above, and $\dot{\gamma}$ is the Shear Rate defined above. The above rheological properties can be determined within the skill of the art by any suitable viscometer other than the aforementioned rotational viscometer. Preparation of our PIB-TEA payload requires care to assure complete polymer solvation and homogeneous dispersion and to avoid polymer shear - degradation. An exemplary PIB-TEA solution on a 50 gallon batch basis is prepared at 40°C to 70°C in a blender, such as a glass vessel 25½ inches deep and 25½ inches in diameter having a stainless steel anchor agitator 21½ inches wide and 22½ inches high centrally mounted therein and the blending system being hydraulic, in a nitrogen atmosphere. TEA is added to the blender first, the stirring speed, as in the above described blender system, of the stirrer is adjusted to about 100 rpm, finely cut PIB having an average dimension of 1/16 inch is added to the TEA over a 1 hour period, the PIB-TEA mixture is stirred for about 7 hours, and the PIB-TEA final solution product is stored under an inert atmosphere until loaded into the rocket shown in FIG. 34. On a 50 gallon basis, 14.5 pounds of PIB are added to 286 pounds of TEA and stirring is continued until all visual solid particles have dissolved, samples are taken on an hourly basis and the viscosity thereof determined by a capillary viscometer until the viscosity of the product is in the range of 150,000 to 250,000 centistokes at 40°C where stirring is discontinued and the aforementioned viscoisty range is acceptable as the final product. Should the 250,000 centistokes viscosity be exceeded, additioned TEA can be added and the PIB-TEA batch re-stirred as above discussed to obtain a product within the aforementioned acceptable viscosity range. PIB-TEA is loaded into case 95 in a nitrogen atmosphere through boss 103 and sealed therein by plug 105 as described above. The stirring operation is critical, because approximately 7 hours are necessary to completely dissolve the polymer and continued stirring after that time results in polymer degradation as demonstrated in the table below by the viscosity data as measured by an Ostwald type viscometer at 40°C.

| Stirring Time at 200 rpm in Hours | Viscosity in Centistokes |
|---|---|
| 24.5 | 126000 |
| 48 | 69000 |
| 69.5 | 48000 |
| 100 | 34000 |

The TEA for the solution described above is clear, colorless liquid which is stable in storage at all prevailing ambient temperatures between −40° to 160°F, is pyrophoric to air, reacts violently with water, has a freezing point of −52.5°C, has a boiling point of 194°C at 760 mm Hg, has a density of 0.837 grams/milliliter at 20°C, and has a viscosity of 2.80 centipoise at 25°C. The PIB-TEA solution is stable as evidenced by periodic viscosity measurements after storage for 2 years at ambient and desert storage temperature (160°F) conditions in contact with the component materials of the casing.

It is obvious that other modifications can be made of our invention, and we desire to be limited only by the scope of the appended claims.

We claim:

1. A projectile assembly adapted to be propelled and guided to the target site by attachable propelling means and capable of being fractured to disseminate its payload comprising of: an elongated fracturable tube-like case adapted to receive a payload closed on one end by an ogive shaped impact nose of uniform thickness interrupted on the surface thereof by filler means and closed on the other end by a reinforced reverse-drawn end defining a recess for receiving fuse means and an adaptor; a fluid payload capable of producing conflagration disposed within said casing by way of said filler means; a filler plug fixedly and sealingly mounted in said filler means to retain said payload therein; fuse means fixedly mounted in said recess and armable in flight and upon impact capable of fracturing said case and disseminating said payload; and an adaptor removably mounted in said recess enclosing and protecting the fuse means and having coupling means for attachment to said propelling means.

2. The projectile of claim 1 wherein the case is metal.

3. The projectile of claim 1 wherein the fuse means comprises a burster charge juxaposed to a set back arming fuse which is armed as the projectile accelerates in flight whereby upon impact, the fuse actuates the burster charge to fracture the casing and disseminate the payload.

* * * * *